US006435672B1

(12) United States Patent
Gröninger et al.

(10) Patent No.: US 6,435,672 B1
(45) Date of Patent: Aug. 20, 2002

(54) METHOD OF INCREASING THE RELIABILITY OF AN INKJET PRINTER

(75) Inventors: Mark Alexander Gröninger, Venlo; Hans Reinten, Velden; Johannes Mathieu Marie Simons, Venlo, all of (NL)

(73) Assignee: OCE Technologies BV, Venlo (NL)

( * ) Notice: Subject to any disclaimer, the term of this patent is extended or adjusted under 35 U.S.C. 154(b) by 56 days.

(21) Appl. No.: 09/635,852

(22) Filed: Aug. 11, 2000

(30) Foreign Application Priority Data

Aug. 12, 1999 (NL) ..... 1012811

(51) Int. Cl.[7] ..... B41J 29/38; B41J 2/045
(52) U.S. Cl. ..... 347/69; 347/10; 347/11
(58) Field of Search ..... 347/9–11, 54, 347/68, 69

(56) References Cited

U.S. PATENT DOCUMENTS

| | | | | |
|---|---|---|---|---|
| 4,498,088 A | | 2/1985 | Kanayama | 347/55 |
| 4,625,220 A | | 11/1986 | Nagashima | 347/48 |
| 4,695,852 A | | 9/1987 | Scardovi | 347/46 |
| 5,818,473 A | * | 10/1998 | Fujii et al. | 347/11 |

FOREIGN PATENT DOCUMENTS

| | | | | |
|---|---|---|---|---|
| DE | 3319353 A1 | | 11/1984 | 347/19 |
| DE | 3319353 A1 | * | 11/1984 | 347/9 |
| JP | 60104335 A | | 6/1985 | 347/19 |

OTHER PUBLICATIONS

JP–A–03–146346, Sep. 18, 1991, abstract only.

* cited by examiner

*Primary Examiner*—John Barlow
*Assistant Examiner*—An H. Do
(74) *Attorney, Agent, or Firm*—Birch, Stewart, Kolasch & Birch, LLP

(57) ABSTRACT

A method of increasing the reliability of an inkjet printer containing at least one pressure chamber provided with a nozzle for jetting ink drops therefrom and wherein when a disturbance in the pressure chamber is detected, the jetting of the ink drops is interrupted for a predetermined period of time. During this "waiting time" no active restoration operations are carried out, but rather the pressure chamber is left on its own to re-establish its normal operating condition prior to resuming the jetting of the ink drops from the nozzle.

14 Claims, 3 Drawing Sheets

METHOD OF INCREASING THE RELIABILITY OF AN INKJET PRINTER

BACKGROUND OF THE INVENTION

The present invention relates to a method of increasing the reliability of an inkjet printer, containing at least one pressure chamber provided with a nozzle, wherein ink drops are jetted from the nozzle and a disturbance is detected in the pressure chamber, whereafter the jetting of the ink drops is interrupted. The present invention also relates to an inkjet printer suitable for use with this method.

This method is known from U.S. Pat. No. 4,625,220 and is used to remove disturbances in the pressure chamber which influence the operation of the pressure chamber. In a printer of this kind, a pressure pulse is generated in the pressure chamber by means of a pulse generator. This results in a pressure wave in the ink in the pressure chamber and an ink drop is jetted from the nozzle. Disturbances in the pressure chamber, e.g. a gas bubble or an unwanted solid particle, result in generated pressure waves in the pressure chamber having a deviation from the standard pressure wave, i.e. the pressure wave which precedes the jetting of a regular (on average good) ink drop. Thus a disturbance may result in ink drops having a volume different from the volume of a regular ink drop. It is also possible that a disturbance may result in the presence of one or more disturbing satellite drops at each jetted ink drop. In an extreme case, a disturbance may even result in the breakdown of the pressure chamber, so that it is subsequently impossible to jet ink drops from the nozzle. The method proposes detecting a disturbance in the pressure chamber whereafter the jetting is temporarily interrupted so that print artefacts can be obviated. During the interruption, an active restoration operation is performed, in which the pressure chamber is flushed with new ink so that the old ink, including the disturbance, is removed from the pressure chamber. After the restoration operation has been carried out, ink jetting is resumed.

An important disadvantage of this method is that flushing the pressure chamber with new ink is accompanied by a considerable loss of expensive ink, since after the flushing operation the ink is frequently discharged to a waste container. Although there are methods known to collect the ink with which the pressure chamber has been flushed out and return it to the ink supply of the inkjet printer, these methods are combined with complex cap constructions since care must be taken at all times to prevent dirt, dust, air or other impurities reaching the ink from the exterior, since they can in turn result in disturbances in the pressure chamber. Moreover, in the latter case a return system is required, which is complex particularly in the case of meltable inks, since these inks solidify shortly after they have left the (heated) pressure chamber. In addition, due to the miniaturization of the print heads of inkjet printers, the caps are often many times larger than the dimensions of one nozzle, so that when one pressure chamber is flushed a number of nozzles of any pressure chambers in the vicinity are also flushed with ink, and this means a further waste.

Another significant disadvantage of such active restoration operations is that the entire print head to which the pressure chamber belongs cannot be used for printing substrates during the flushing operation, so that the inkjet printer productivity is under considerable pressure if high reliability is required.

SUMMARY OF THE INVENTION

The method according to the present invention is intended to obviate these disadvantages. To this end, a method has been developed in which the jetting is interrupted for a predetermined time. During this time no active restoration operations are carried out to remove the disturbance, and the pressure chamber is simply left to itself. After the predetermined time has elapsed, jetting of the ink drops from the nozzle of the pressure chamber is resumed. This method is based on the recognition that practically all disturbances disappear by themselves if the pressure chamber is not activated for a specific time. This method has the considerable advantage that there is no need to flush the pressure chamber with new ink in order actively to remove the disturbance from the pressure chamber. As a result no ink is wasted in removing the disturbance. Another important advantage is that any other pressure chambers in the print head need not interrupt the jetting, so that a print job started can be continued.

The temporary non-activation of the pressure chamber in which a disturbance is present may lead to very small artefacts in a printed image, which are practically invisible to the observer, and if considered necessary they can be intercepted in the manner known to the skilled man, for example in the manner known from Japanese Patent 60-104335. By the use of such a method there is practically no negative effect on the inkjet printer productivity and the temporary interruption of the jetting of the pressure chamber is prevented from resulting in print artefacts in the printed image. Another advantage of the method according to the present invention is that it is already known in advance—i.e. directly prior to the actual interruption of jetting—when jetting will be resumed, since resumption is not dependent on an active restoration operation being completed. This advantage can be used, inter alia, in determining the most optimal print strategy.

In a preferred embodiment, directly prior to the disturbance, a predetermined number of pressure pulses is generated following the detection of a previous disturbance. It has been found that most of the pressure waves which differ from the standard pressure wave do not lead to visible print artefacts. If jetting of the pressure chamber were temporarily interrupted after the occurrence of such a disturbance, it would result in an unnecessary fall-off in the inkjet printer productivity. Consequently, it is advantageous to determine which disturbances form a risk to the operation of the pressure chamber, and to interrupt the jetting of that chamber only when such disturbances are present.

It has now been found that a disturbance practically certainly leads to visible print artefacts if the disturbance does not disappear during the jetting of a specific number of ink drops from said pressure chamber. The reason why most disturbances disappear spontaneously during the jetting of a specific number of ink drops and that a small number of the disturbances increases precisely during said jetting is not completely clear. It may be that most disturbances are small gas bubbles which dissolve spontaneously in the ink before they reach a size such as to be accessible to growth under the influence of the pressure pulses. Another reason might be that disturbances occur mainly in the neighborhood of the nozzle with which they are jetted with the ink drops from the pressure chamber before they can lead to perceptible print artefacts. In this preferred embodiment, after it has been found that a disturbance is present in the pressure chamber, a specific number of pressure waves is generated in the associated pressure chamber in order to jet ink drops, whereafter it is determined whether there is still a disturbance present. If not, then the disturbance has obviously disappeared and there is no further acute risk to the operation of the pressure chamber. If the disturbance is still present, then there is a considerable chance that the last detected disturbance has or will have a perceptible negative effect on the function of the pressure chamber, so that visible print artefacts will occur in a printed image. To obviate this, jetting is temporarily interrupted and the pressure chamber is left to itself for a specific time.

In another preferred embodiment, a maximum of 100 pressure pulses is generated in the pressure chamber between the previous and the later disturbance. By making the number of pressure pulses not more than 100, the disturbance is prevented from becoming too large, so that it would take too long before it disappears when jetting is interrupted. In another preferred embodiment, the number of pressure pulses is smaller than or equal to 50. In yet another preferred embodiment said number is smaller than or equal to 20. This number is always predetermined, and hence known at the time when a start is made on generating the first pressure pulse of said number, but can be adapted to the type of machine, the ink used, the machine history (wear), the magnitude of the disturbance, and so on. In another preferred embodiment of the method according to the present invention, the inkjet printer comprises at least a first and a second pressure chamber, and after detection of a disturbance in the first pressure chamber the jetting of ink drops from the nozzle of said pressure chamber is interrupted for a predetermined time but the jetting of ink drops from the nozzle of the second pressure chamber is continued during the interruption. In this way, considerable reliability of the inkjet printer is combined with a minimal loss of productivity.

In order to be able to accurately determine whether a disturbance is present in the pressure chamber, the latter is preferably provided with an electromechanical transducer (piezo-element), a drive circuit with a pulse generator to activate the transducer, and a measuring circuit such that the disturbance is detected by measuring the electrical signal generated by the transducer in response to an activation, by means of the measuring circuit. In a piezo-inkjet printer of this kind, the transducer is activated by generating an electrical pulse with the pulse generator which forms part of the drive circuit. In this way the transducer is subject to deformation so that the pressure wave is generated in the pressure chamber and accordingly an ink drop is jetted from the nozzle. The pressure wave generated in turn deforms the electromechanical transducer so that it generates an electrical signal. By measuring this signal with the measuring circuit it is possible to determine whether a disturbance is present in the pressure chamber since a disturbance will result in a deviation in the generated pressure wave. In this way, the transducer, the primary task of which is to generate pressure waves in the pressure chamber, is also used as a sensor. It has been found that by measuring the electrical signal generated by the transducer because the latter is in turn subjected to mechanical deformation by the pressure wave which it has generated in the pressure chamber, it is possible accurately to determine the magnitude of the deviation of a pressure wave from a standard pressure wave. In another preferred embodiment, the drive circuit is opened when the measuring circuit is closed. This further improves detection of the deviation of a pressure wave generated in the pressure chamber by activating the transducer. The present invention also relates to an inkjet printer suitable for use with the present method. The inkjet printer is preferably a piezo-inkjet printer. Also, preferably, a meltable ink, i.e. a hot-melt ink, is used in the printer.

BRIEF DESCRIPTION OF THE DRAWINGS

The present invention will be explained in detail below with reference to the accompanying drawings wherein.

DETAILED DESCRIPTION OF THE INVENTION

Figure 1:
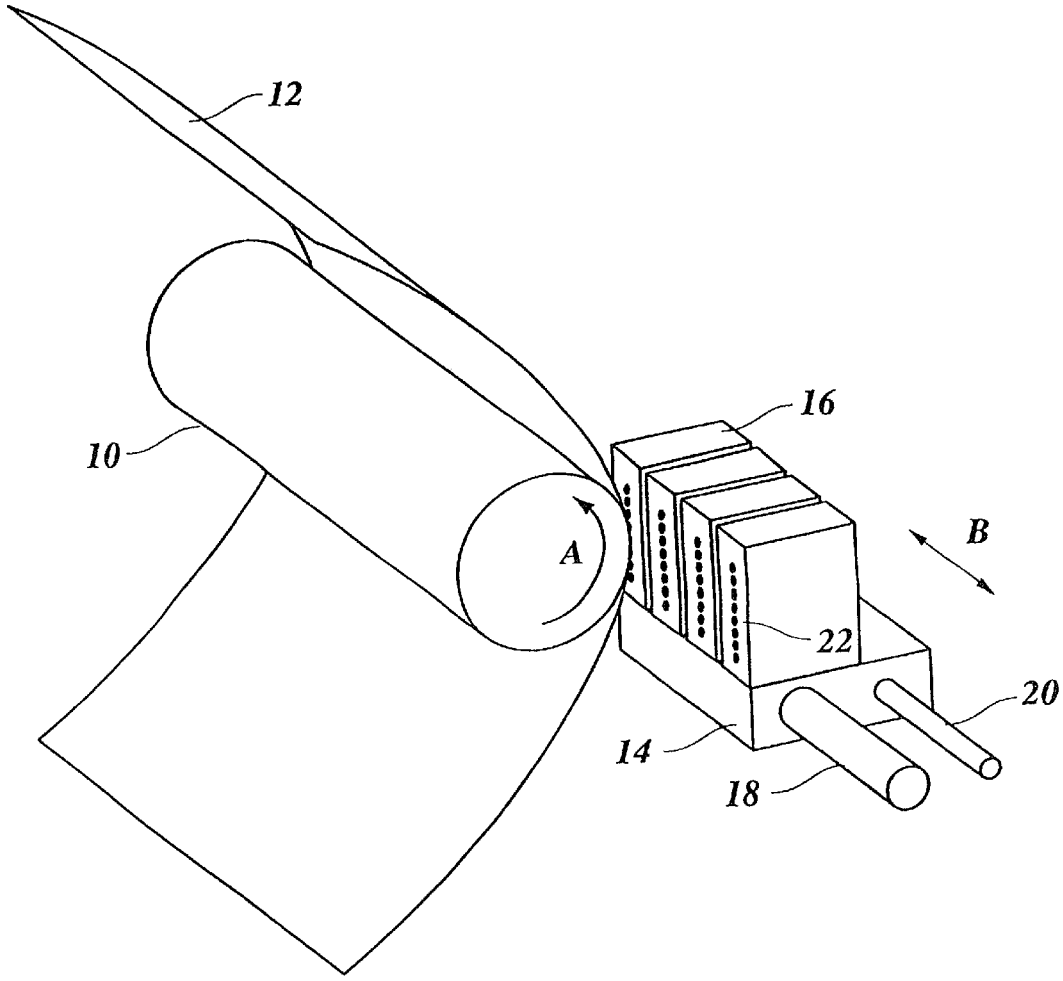
FIG. 1 is an example of an inkjet printer.

FIG. 1 shows an inkjet printer provided with a number of pressure chambers with nozzles. In this embodiment, the printer comprises a roller 10 to support a receiving medium 12 and guided along the four print heads 16. The roller 10 is rotatable about its axis as indicated by arrow A. A carriage 14 carries four print heads 16, one for each of the colors: cyan, magenta, yellow and black, and can be moved in reciprocation in the direction indicated by the double arrow B, parallel to roller 10. In this way the print heads 16 can scan the receiving medium 12. The carriage 14 is guided on rods 18 and 20 and is driven by suitable means (not shown).

In the embodiment shown in the drawing, each print head 16 comprises eight print chambers, each with its own nozzle 22, which nozzles form an imaginary line perpendicular to the axis of the roller 10. In a practical embodiment of an inkjet printer, the number of pressure chambers per print head 16 will be many times greater. Each pressure chamber is provided with an electromechanical transducer (not shown) and associated drive circuit. In this way, the pressure chamber, transducer and drive circuit form a unit which can serve to jet ink drops in the direction of the roller 10. If the transducers are activated image-wise, an image built up of ink drops forms on the receiving medium 12.

Figure 2:
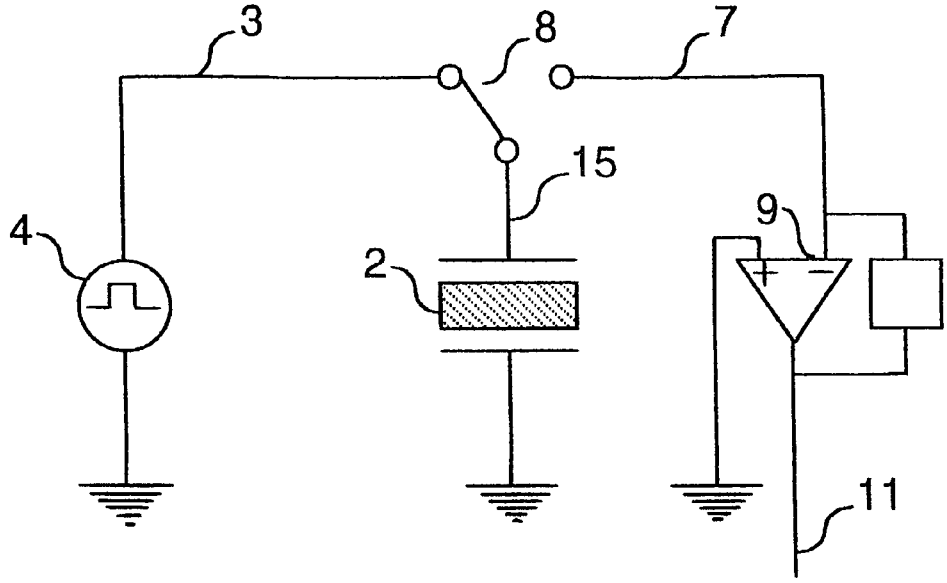
FIG. 2 is an example of an electrical schematic diagram for the detection of a disturbance in an inkjet printer according to a preferred embodiment of the present invention.

FIG. 2 is an example of the block schematic for the detection of a disturbance in an inkjet printer according to a preferred embodiment of the present invention. The circuit comprises an electromechanical transducer 2, a drive circuit 3, and a measuring circuit 7. Drive circuit 3 which is provided with pulse generator 4, and measuring circuit 7 which is provided with amplifier 9, are connected to piezo-element 2 via a common line 15. The circuits are opened and closed by selector switch 8. After a pulse has been applied across the piezo-element 2 by the pulse generator 4, the pulse deforms the pressure chamber so that a pressure wave is generated therein. This pressure wave in turn deforms the piezo-element 2, which element converts the deformation into an electrical signal. If, after the pulse expires, the selector switch 8 is so switched that the measuring circuit is closed, the said electrical signal is discharged across the measuring circuit 7. This signal is amplified by amplifier 9 and is fed via output 11 to an interpretation circuit (not shown). Interpretation of the signal can be implemented both in the printer hardware and in the printer control software.

In this way it is possible to measure generated pressure waves in real time, i.e. during printing. In view of the simplicity of the circuit, each pressure chamber of the inkjet printer can be provided with a measuring circuit of this kind. In principle it is possible to measure each pressure wave generated by the transducer, so that a disturbance can be detected immediately after it occurs (or enters the pressure chamber). Deviations from the standard pressure wave can be determined, for example, by measuring quantities such as the frequency, amplitude, zero-axis crossing, phase, etc., of each pressure wave.

FIGS. 3*a*–3*d* are an example of electrical signals generated by the transducer of a piezo-hotmelt inkjet printer in response to the generation of a pressure wave in the pressure chamber using a circuit as shown in FIG. 2.

The continuous line in each of FIGS. 3*a* to 3*d* indicates what the relevant signal is as measured after the generation of a specific pressure wave. The broken line indicates what the standard electrical signal is as measured after the generation of a pressure wave in the pressure chamber if there is no disturbance (the standard signal). The y-axis shows in arbitrary units the potential of the generated signal. The x-axis gives the time in arbitrary units.

Figure 3A:
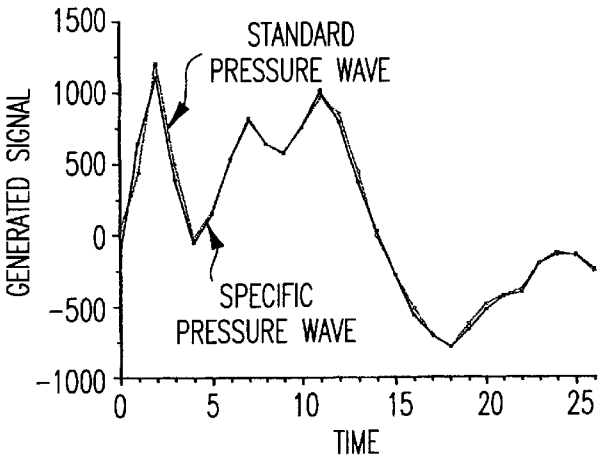
FIGS. 3*a*–3*d* show the deviation of a pressure wave generated in the presence of a disturbance relative to the standard pressure wave.
Figure 3B:
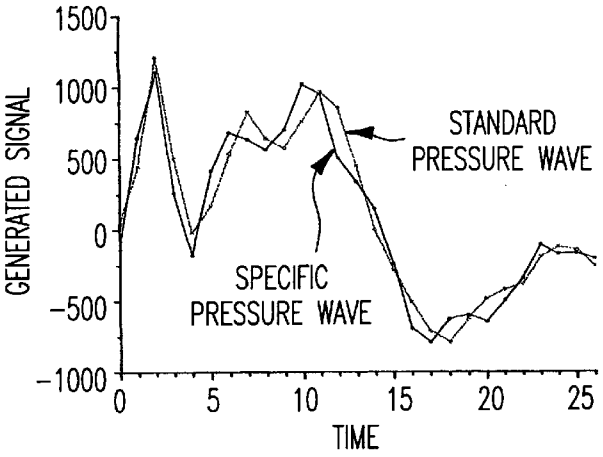
Figure 3C:
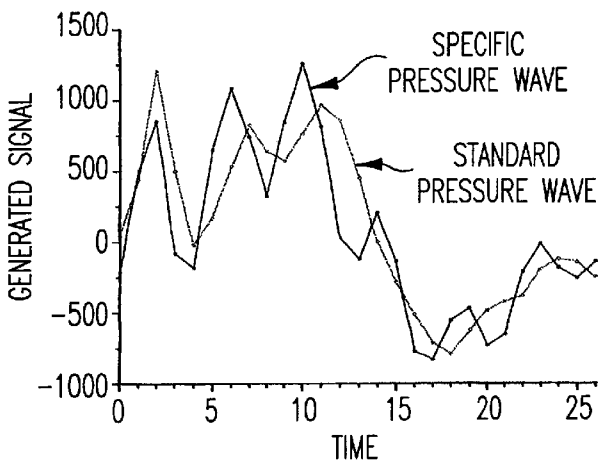
Figure 3D:
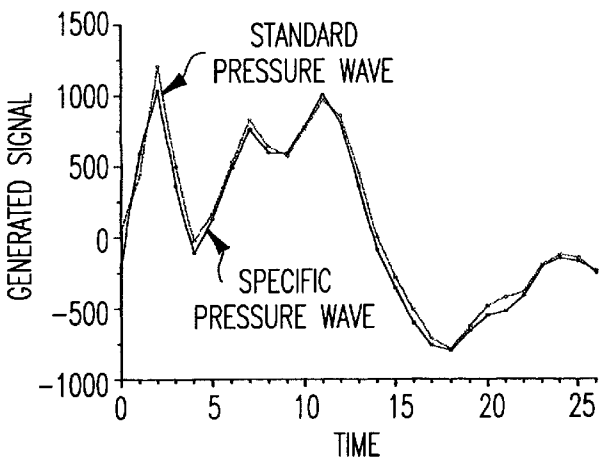

The continuous line in FIG. 3*a* denotes the signal after the generation of a specific pressure wave in the pressure chamber. It will be apparent that this signal coincides practically, completely with the standard signal. Obviously there is no disturbance in the pressure chamber. FIG. 3*b* shows the signal measured after the situation described above, when a subsequent pressure pulse is generated with the electromechanical transducer so that a following pressure wave is generated in the pressure chamber. It is now apparent that there is a significant difference between the electrical signal measured and the standard signal, and this is indicative of a disturbance in the pressure chamber. The electrical signal generated after a following pressure pulse is shown in FIG. 3*c*: the influence of the disturbance appears to have increased, and in this case this is manifest in an increase in the frequency and amplitude of the signal with respect to the previous signal. Three pressure pulses are next generated. The signal generated by the transducer in response to the pressure wave generated by the third pressure pulse is shown in FIG. 3*d*. It will be apparent that the measured electrical signal again substantially coincides with the standard signal. It follows from this that the disturbance has disappeared, four pressure pulses after being detected for the first time.

Disturbances of the type described above practically never result in visible printing artefacts. If in such a case a restoration operation were started immediately after detection of the initial disturbance, it would have been a superfluous restoration operation. Obviously a pressure chamber has a self-restoring capacity, so that most of the disturbances disappear of themselves during the jetting of ink drops. In practice, up to 99% of such disturbances disappear in this way. This is dependent, inter alia, on the shape of the generated pulse, the geometry of the pressure chamber and the nozzle, and the material of which the latter are made, the temperature of the ink, the type of ink (e.g. hot-melt or fluid ink), the pre-treatment of the ink (filtering, de-aerating), additions to the ink (surfactants, salts) and so on.

A small number of disturbances do not disappear during the jetting of ink drops from the chamber. Obviously in these cases the self-restoring capacity of the pressure chamber is not adequate to counteract the increase in the disturbance. For example it is possible that small gas bubbles will grow to large gas bubbles due to the continuous generation of pressure waves in the pressure chamber, resulting in a perceptible negative effect on the operation of a print pressure chamber. According to the present invention, after the detection of these disturbances, which can be recognised because the electrical signal after the generation of a specific number of pulses, e.g. 50, still differs from the standard signal, jetting is interrupted for a predetermined time. During this waiting time, the pressure chamber is not activated and no active restoration operation is carried out. It has now been found that such disturbances also practically always disappear from the pressure chamber if no ink drops are jetted for a specific time.

Table 1 shows the restoration of a pressure chamber against the waiting time. In this example, use is made of a piezo-hotmelt inkjet printer. Whenever a disturbance is detected in a specific pressure chamber, twenty successive pressure waves are generated in that pressure chamber. Immediately thereafter a check is made whether there was still a disturbance. In cases in which a disturbance was present after the 20 successive pulses (in 5% of the cases in this example), jetting was temporarily interrupted for a specific waiting time.

The Table shows the number of cases in which the pressure chamber was restored after the waiting time. It will be apparent that after a waiting time of 300 ms a disturbance of this kind always disappeared in this inkjet printer. It has been found that the waiting time in each individual case depends on a large number of factors, such as the materials from which the pressure chamber and the nozzle are made, the geometry of both, the type of ink, and so on. In principle it should be possible to use just a fixed waiting time determined, for example, directly after production of the inkjet printer. However, since the waiting time depends on other factors as well, it is preferable to make the waiting time dependent thereon. For example it has been found that the average waiting time required for restoration is longer with increasing disturbance magnitude. If action is taken more quickly, then the restoration time is reduced, and this is to the benefit of the inkjet printer productivity. The waiting time can also be dependent on the inkjet printer wear and particularly a change in the pressure chamber condition.

However, if a fixed waiting time is chosen, which is to the advantage of the printer simplicity, it is preferable to choose a waiting time such that, on average, all the disturbances just disappear. In a small number of cases this means that there will still be a disturbance present after the waiting time, but it is then immediately registered and after this, a subsequent waiting period can immediately be started. Even if a disturbance has not disappeared after a specific number of waiting periods, then as an ultimum remedy it is possible to adopt an active restoration operation as known from the prior art.

TABLE 1

Restoration of a pressure chamber against waiting time

| Waiting time (ms) | Restoration percentage |
|---|---|
| 1 | 0 |
| 20 | 0 |
| 100 | 40 |
| 200 | 80 |
| 250 | 60 |
| 300 | 100 |
| 400 | 100 |
| 2000 | 100 |

The invention being thus described, it will be obvious that the same may be varied in many ways. Such variations are not to be regarded as a departure from the spirit and cope of the invention, and all such modifications as would be obvious to one skilled in the art are intended to be included within the scope of the following claims.

What is claimed is:

1. A method of increasing the reliability of an ink jet printer containing at least one pressure chamber provided with a nozzle for jetting ink drops therefrom which comprises detecting a disturbance in the pressure chamber, interrupting the jetting of the ink drops from the nozzle for a predetermined period of time to enable the ink jet printer to self-correct itself, and resuming the jetting of the ink drops from the nozzle after the predetermined period of time has elapsed.

2. The method of claim 1, wherein during the operation of the ink jet printer, standard pressure waves are generated in the pressure chamber and the disturbance is detected by its variation from the standard pressure waves.

3. The method according to claim 1, wherein the jetting of an ink drop is effected by generating a pressure pulse in the pressure chamber, wherein directly prior to the disturbance a predetermined number of pressure pulses is generated following the detection of a previous disturbance.

4. The method according to claim 3, wherein the specific number of pressure pulses is less than or equal to 100.

5. The method according to claim 4, wherein the specific number of pressure pulses is less than or equal to 50.

6. The method according to claim 5, wherein the specific number of pressure pulses is less than or equal to 20.

7. The method according to claim 1, in which the inkjet printer comprises at least one first and one second pressure chambers wherein when detecting a disturbance in the first pressure chamber, the jetting of ink drops from the nozzle of said pressure chamber is interrupted for a predetermined time, the jetting of ink drops from the nozzle of the second pressure chamber being continued during the interruption.

8. The method according to claim 7, wherein the pressure chambers are provided with an electromechanical transducer, a drive circuit provided with a pulse generator to activate the said transducer and a measuring circuit, wherein the electrical signal generated by the transducer in response to an activation is measured by means of the measuring circuit.

9. The method according to claim 7, wherein the drive circuit is opened when the measuring circuit is closed.

10. The method of claim 1, wherein the printer uses hot-melt ink.

11. An inkjet printer comprising at least one pressure chamber provided with a nozzle for jetting ink drops therefrom, means for deforming the pressure chamber so that a pressure wave is generated therein, means for measuring the pressure waves generated therein during printing, means for detecting a disturbance in the pressure chamber, means for interrupting the jetting of the ink drops from the nozzle for a predetermined period of time to enable the system to self-correct, and means for resuming the jetting of the ink drops from the nozzle after the predetermined period of time has elapsed.

12. The inkjet printer according to claim 11, wherein the inkjet printer is a piezo-inkjet printer.

13. The inkjet printer according to claim 12, wherein the printer uses hot-melt ink.

14. The ink jet printer of claim 11, which further comprises means for deforming the pressure chamber so that a pressure wave is generated therein, and means for measuring the pressure waves generated therein during printing.

* * * * *